US008479649B2

(12) United States Patent
Hosaka

(10) Patent No.: US 8,479,649 B2
(45) Date of Patent: Jul. 9, 2013

(54) IMPRINTER INCLUDING A ROLLER WITH AN ELASTIC MEMBER BEING RADIALLY DEFORMED DURING AN IMPRINTING OPERATION

(75) Inventor: Yukio Hosaka, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 621 days.

(21) Appl. No.: 11/905,724

(22) Filed: Oct. 3, 2007

(65) Prior Publication Data

US 2008/0134910 A1 Jun. 12, 2008

(30) Foreign Application Priority Data

Dec. 8, 2006 (JP) ..... 2006-332279

(51) Int. Cl.
*B31F 1/07* (2006.01)
*B41F 3/14* (2006.01)

(52) U.S. Cl.
USPC ..... 101/3.1; 101/269; 101/250

(58) Field of Classification Search
USPC ..... 101/269, 250; 492/18, 43, 50
See application file for complete search history.

(56) References Cited

U.S. PATENT DOCUMENTS

| | | | | |
|---|---|---|---|---|
| 3,538,848 | A * | 11/1970 | Barbour | 101/269 |
| 3,592,134 | A * | 7/1971 | Patterson, Jr. | 101/269 |
| 4,573,816 | A | 3/1986 | Pamler | |
| 5,062,361 | A | 11/1991 | Kabelsky | |
| 5,130,751 | A | 7/1992 | Sato et al. | |
| 5,257,965 | A * | 11/1993 | Fuchs et al. | 492/6 |
| 6,280,371 | B1 * | 8/2001 | Krippelz | 492/39 |

FOREIGN PATENT DOCUMENTS

| | | | |
|---|---|---|---|
| JP | 48-70704 | U | 9/1973 |
| JP | 53-96174 | A | 8/1978 |
| JP | 53-126713 | U | 10/1978 |
| JP | 56-104963 | | 8/1981 |
| JP | 57-138975 | | 8/1982 |
| JP | 61-206767 | A | 9/1986 |
| JP | 63-92561 | A | 4/1988 |
| JP | 1-119360 | U | 8/1989 |
| JP | 07-179240 | A | 7/1995 |
| JP | 10-181930 | A | 7/1998 |

(Continued)

OTHER PUBLICATIONS

Japanese Office Action issued on Oct. 31, 2011.
Office Action in U.S. Appl. No. 12/801,075 dated Jan. 5, 2012.
Office Action in U.S. Appl. No. 12/801,075 dated May 18, 2012.

(Continued)

*Primary Examiner* — Matthew G Marini
(74) *Attorney, Agent, or Firm* — McGinn IP Law Group, PLLC

(57) ABSTRACT

An imprinter includes a printing base for mounting a card and a print paper to be imprinted on a predetermined area thereof, a carriage that is movable above the printing base, a roller shaft arranged at a position of a predetermined height from the card mounting surface of the printing base, a roller including an outer periphery of hard material a center boss that is in rotational engagement with the roller shaft and elastic members provided between the outer periphery and the center boss of the roller. The elastic members are radially deformed during imprinting operation to cause the outer periphery of the roller to radially move relative to the center axis of the roller shaft into a state of eccentric circle in vertical section, so that the embossed information of the card may be transcribed onto the print paper.

17 Claims, 11 Drawing Sheets

FOREIGN PATENT DOCUMENTS

| | | | |
|---|---|---|---|
| JP | 2001-200832 | A | 7/2001 |
| JP | 2002-370438 | | 12/2002 |
| JP | 2006-150828 | | 6/2006 |
| TW | 111570 | | 5/1994 |

OTHER PUBLICATIONS

Taiwanese Office Action issued on Jul. 25, 2012, with partial English-language translation.

* cited by examiner

IMPRINTER INCLUDING A ROLLER WITH AN ELASTIC MEMBER BEING RADIALLY DEFORMED DURING AN IMPRINTING OPERATION

BACKGROUND OF THE INVENTION

1. Field of the Invention

The present invention relates to an imprinter for imprinting or transcribing onto a print paper including the books and debit slips the information represented as convexly embossed on a card. The imprinter is generally provided with a roller of hard material which is moved as is rolled on the card when the transcription is carried out while the roller is kept in point contact with the information represented as embossed on the card which is placed as fixed, so that a clear and high quality transcription of information may be obtained without necessity of any specific adjusting operation on the side of the user.

2. Description of the Related Art

The literature that is Japanese Patent Application laid open 2006-150828 and/or another literature that is Japanese Patent Application laid open 2002-370438 disclose the imprinters respectively, the imprinters being substantially composed of a base for supporting a card having embossed parts formed thereon, a carriage that is substantially U-shaped straddling the base and is movable on the base, the carriage rotatably supporting an ink roller above the base and rotatably supporting a backup roller extended in parallel with the ink roller below the base and further composed of a mechanism provided on the carriage for adjusting the distance between the ink roller and the backup roller. The adjusting mechanism is operated to adjust the distance between the ink roller and the backup roller before the imprinter is shipped so that the ink roller may be positioned at the height substantially corresponding to the height of the embossed parts of the card to give an optimum printing pressure. The adjusting mechanism is further operated to make a final fine adjustment as to the position of the ink roller at the stage of actual use of the user in reference to card that is practically used by the user so as to obtain an optimum quality of transcription.

Further an ink roller of elastic material such as a hard gum is used in the conventional imprinter. The literature that is Japanese utility Model Application laid open Sho 56-104963 discloses a printing roller 22 which may be adjustable as to the height so as to obtain an optimum transcription. Further the literature that is Japanese Patent Application laid open Sho 57-138975 discloses printing roller 30 that is ink impregnated or no ink impregnated and is adjustable as to the vertical position by way of elastic members 37.

SUMMARY OF THE INVENTION

According to the conventional adjusting mechanisms as mentioned above, the adjusting operation is rather troublesome and almost impossible to obtain a high quality of transcription in response to the embossed information of the card which includes a predetermined height and height errors. In order to overcome such problem, the ink roller may be made of a hard gum. However it is unavoidable that the embossed parts will sink into the roller during imprinting operation resulting in blotted and dirty transcription of information. It is, therefore, a principal object of the invention to provide an imprinter having a roller having a rigid body which may be rotatingly moved on the card in point contact with the convexly embossed portions of the card during imprinting operation, so that a clear and high quality transcription of information may be obtained from the card to the print paper without necessity of adjusting operation on the side of the user as to the vertical position of the roller against the embossed card.

The problems have been solved by the invention as defined in claim 1, wherein the imprinter comprises a printing base for mounting a card and a print paper to be imprinted on a predetermined area thereof, a carriage that is movable above the printing base, a roller shaft provided as is housed within the carriage and fixedly arranged at a position of a predetermined height from the card mounting surface of the printing base, a roller composed of an outer periphery of a rigid body a center boss that is in rotational engagement with the roller shaft and elastic means provided between the outer periphery and the center boss of the roller, the elastic means being radially deformed during imprinting operation to cause the outer periphery of the roller to radially move relative to the center axis of the roller shaft into a state of eccentric circle in vertical section, so that the embossed information of the card may be transcribed onto the print paper.

Further the problems have been solved by the invention as defined in claim 2, wherein the elastic means may include a plurality of spring ribs radially extended between the outer periphery and the center boss of the roller. Further the problems have been solved by the invention as defined in claim 3, wherein the elastic means may include a gum and the like filled between the outer periphery and the center boss of the roller. Further the problems have been solved by the invention as defined in claim 4, wherein the spring ribs may be formed in one body with the outer periphery and the center boss of the roller by use of a single material including synthetic resin or metal.

Further the problems have been solved by the invention as defined in claim 5, wherein the imprinter comprises a printing base for mounting a card and a print paper to be imprinted on a predetermined area thereof, a carriage that is movable above the printing base, a roller that having a rigid body and is provided as is housed within the carriage for transcribing the information represented as embossed on the card, a roller shaft for fixedly supporting the roller, bearings for rotatably supporting the roller shaft at a position of a predetermined height from the card mounting surface of the printing base, elastic means provided between the bearings and the roller shaft, the elastic means being radially deformed during imprinting operation to cause the roller to radially move relative to the bearings so that the embossed information of the card may be transcribed onto the print paper.

Further the problems have been solved by the invention as defined in claim 6, wherein the elastic means may include a plurality of coil springs. Further the problems have been solved by the invention as defined in claim 7, wherein the elastic means may include a soft synthetic gum.

Further the problems have been solved by the invention as defined in claim 8, further comprising adjusting means manually operated to adjust the height of said roller from said printing base, thereby to adjust the density of transcription.

According to the invention, the roller having a rigid body is rotatingly moved on the embossed card absolving a predetermined height and height errors of the embossed portions of the card so as to obtain a high quality of transcription. As the roller is so formed as to absolve the height and height errors of the embossed portions of the card during imprinting operation, the user is not required to adjust the position relative to the upper surface of the card. On the other hand, as the adjusting range is increased in comparison with the conventional imprinter, the adjusting operation is considerably easy. Particularly according to the inventions as defined in claims 1 to 3, the roller is so formed as to be radially deformed through spring action with the position of center axis being unchanged, and thus the adjusting range is increased to contribute to realization of a high quality transcription of information. Similarly the inventions as defined in claims 4 to 6 are designed to obtain the same effects as the inventions as defined in claims 1 to 3.

DESCRIPTION OF THE PREFERRED EMBODIMENTS

Figure 1:
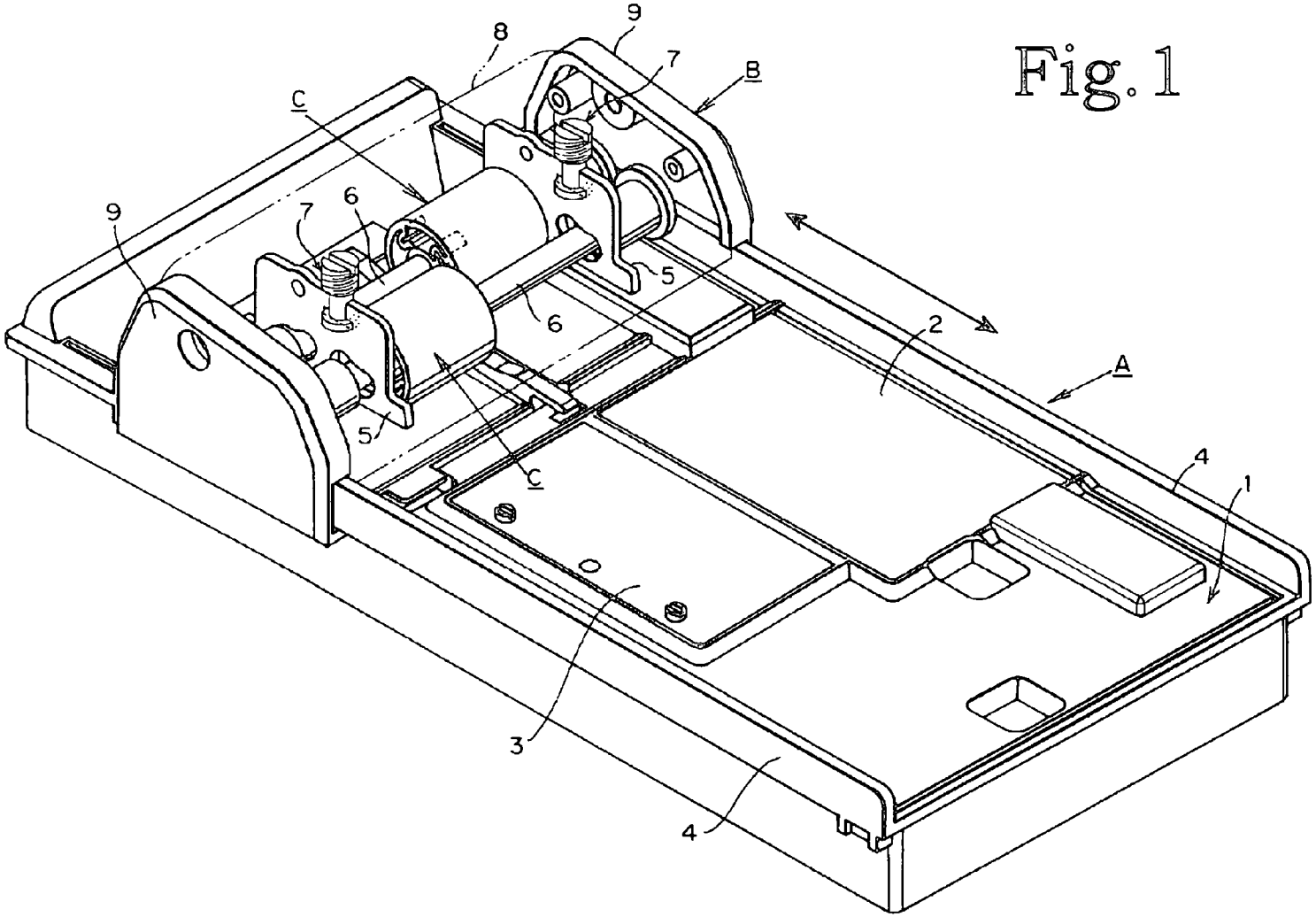
FIG. 1 is a perspective view of a first embodiment of the invention showing an imprinter having a carriage partly removed.
Figure 2:
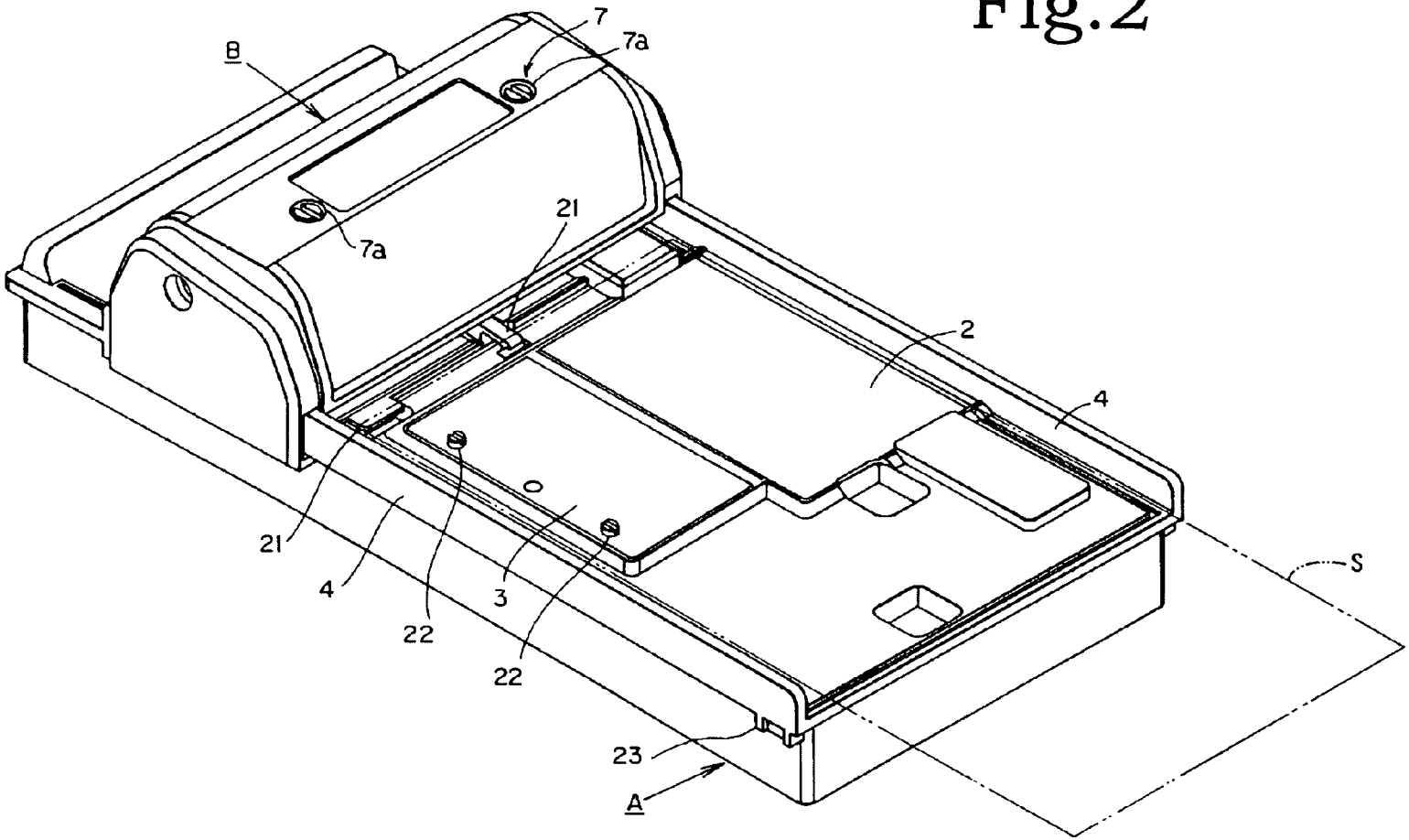
FIG. 2 is a perspective view of the imprinter of the invention showing the outer appearance thereof.
Figure 3A:
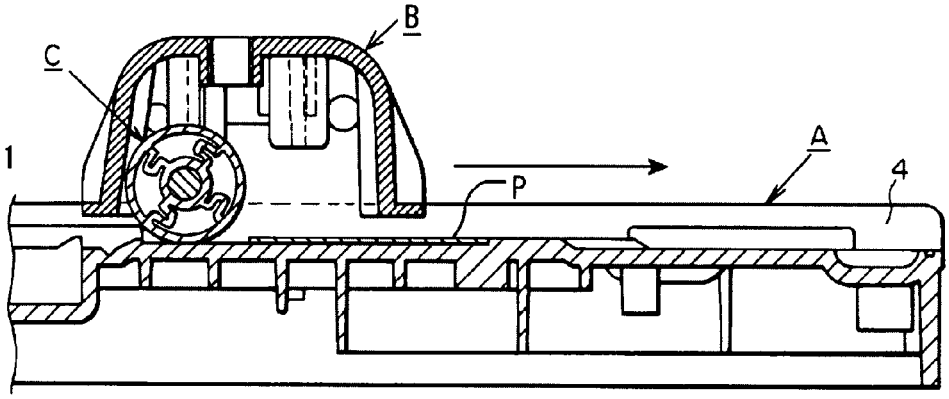
FIG. 3A is a side elevational view of the imprinter shown in vertical section wherein the imprinter is not operated.
Figure 3B:
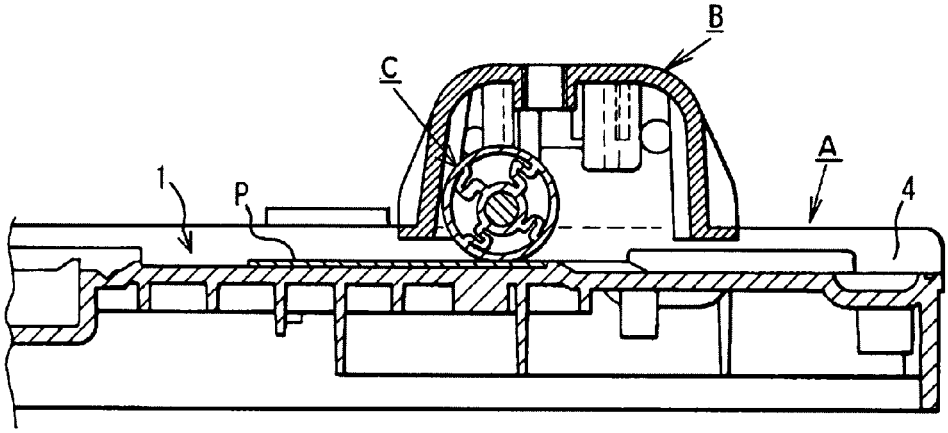
FIG. 3B is the side elevational view of the imprinter shown in vertical section wherein the imprinter is operated.
Figure 4A:
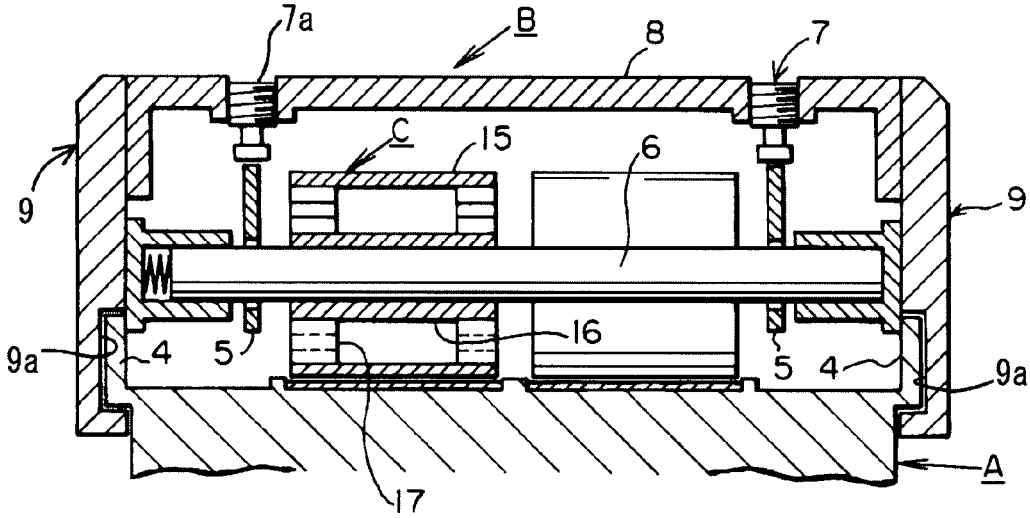
FIG. 4A is a side elevational view of an essential part of the imprinter shown in vertical section.
Figure 4B:
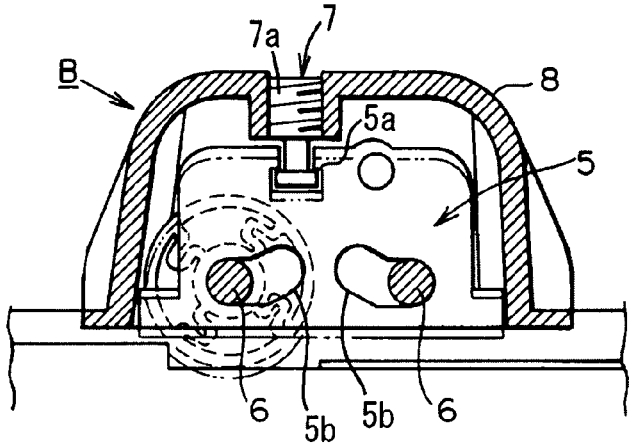
FIG. 4B is a side elevational view of FIG. 4A shown in vertical section.

The invention will be described in detail in reference to the attached drawings. FIGS. 1 and 2 show a first embodiment of the imprinter according to the invention. The imprinter of the invention is essentially composed of a printing base A which is provided with a predetermined area for mounting a card thereon for transcription, a carriage B that is substantially U-shaped in vertical section and is movable above the printing base A and a roller C that is rotatably housed within the carriage B. The carriage may be manually moved on the printing base A so that the roller C may be rotatingly moved on and across a print paper S (books or debit slip) positioned on the card having information represented as convexly embossed on the upper side thereof and positioned on the printing base A. Thus the embossed information of the card P may be transcribed onto the print paper S. Incidentally in FIG. 2, the reference numeral 21 are holders respectively for holding the print paper to be imprinted. The reference numeral 22 denotes screws respectively for holding a shop name plate on the printing base A. The reference numeral 23 denotes a stopper for stopping the movement of the carriage.

The printing base A is provided with a flat area 2 for receiving the card P and is provided with another flat area 3 for receiving the shop name plate. Further the printing base A has guide rails 4 provided on both sides thereof respectively for guiding the carriage B. The carriage B holds the roller C so that the roller C may be rotated. Namely the carriage B has guide plates, 5, 5 provided as are opposite to each other with a predetermined space provided therebetween for rotatably supporting a roller shaft 6 with a predetermined distance provided between the rotation axis of the roller C and the upper surface of the card P. Further the carriage B is provided with adjusting portions 7, 7 for adjusting the distance between the roller C and the upper surface of the card. The carriage B is further provided with an upper cover 8 and side covers 9 on both sides of the upper cover 8 for covering the guide plates, 5, 5, the roller shaft 6, and the roller C.

The side covers 9, 9 have grooves 9*a*, 9*b* formed at the lower side thereof respectively and are kept in engagement with the guide rails 4, 4 of the printing base A so that the carriage may be slidingly moved on the printing base A along the guide rails 4, 4. Further the adjusting portions 7, 7 include adjusting screws 7*a*, 7*a* respectively which are in threaded engagement with the upper cover 8 and have lower portions positioned in engagement with connecting portions 5*a*, 5*a* of the guide plates 5, 5 respectively. The adjusting screws 7*a*, 7*a* are accessible at the top of the upper cover 8 and may be manually rotated by use of a driver and the like to adjust the vertical position of the guide plates 5, 5, so that the roller C may be pressed against the embossed surface of the card P with an optional pressure and therefore against the print paper S placed on the card. Thus different tones of print density may be obtained.

Figure 5:
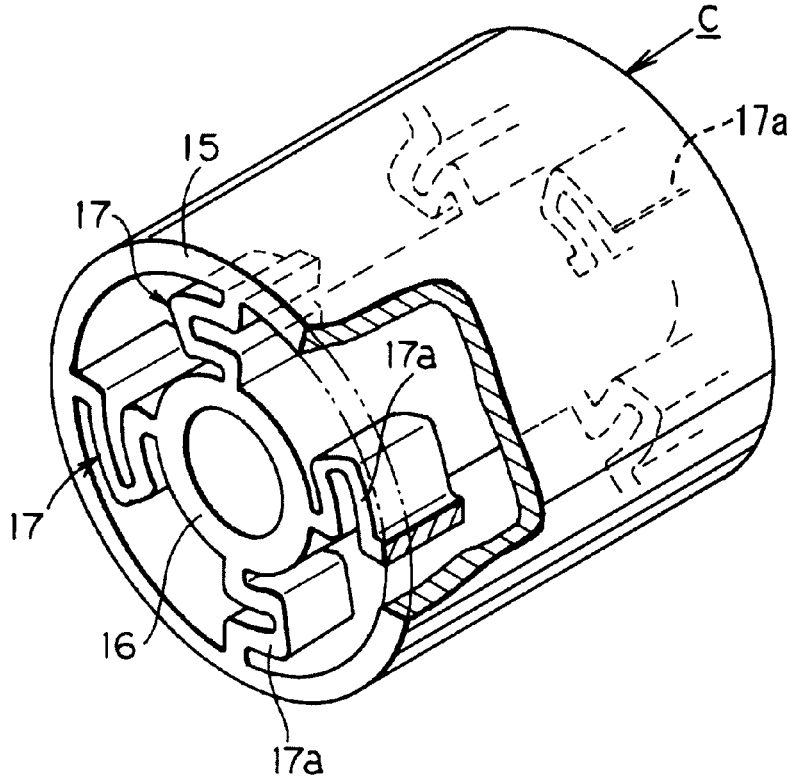
FIG. 5 is a perspective view of a roller of the imprinter shown as partly removed.
Figure 6A:
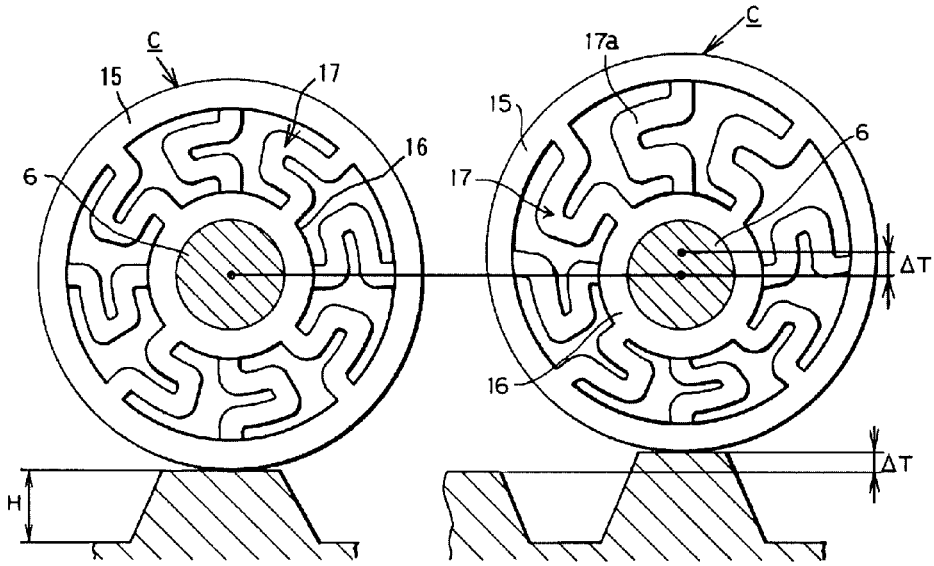
FIG. 6A is a front elevational view of the roller wherein the roller is shown as radially deformed into a state of eccentricity in vertical section with absorption of a predetermined height and height errors respectively of embossed parts of a card during imprinting operation.
Figure 6B:
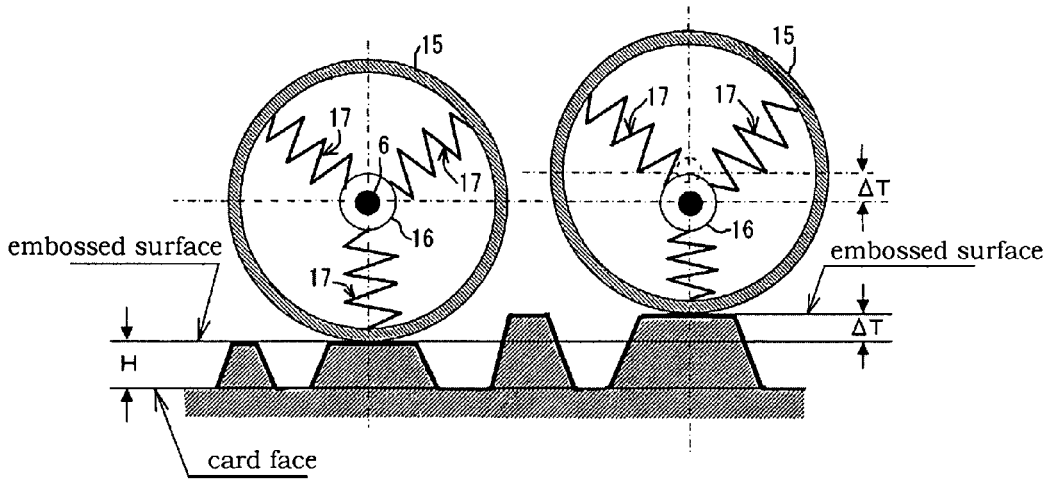
FIG. 6B is a front elevational view of the roller diagrammatically showing the conditions of FIG. 6A.

The roller C is formed with an outer periphery 15 of a rigid body, a center boss 16 and a plurality of arms 17 which are radially extended between the outer periphery 15 and the center boss 16. The radially extended arms 17 are laterally bent in U-shape at the intermediate thereof to provide spring ribs 17*a* for giving a spring effect against radial pressure given toward the center boss 16. At least three spring ribs 17*a* are required as are arranged with an equal angular space provided therebetween. The roller C may be formed in one body with synthetic resin as composed of the outer periphery 15, the center boss 16 and the spring ribs 17*a*. FIG. 5 shows the roller C that is provided with four spring ribs 17*a* in one (first) set with an equal angular space provided therebetween at one end side thereof and is further pro vided with four spring ribs 17*a* in another (second) set with an equal angular space provided therebetween at the opposite end side thereof. Incidentally, the spring ribs 17*a* in the second set are angularly displaced by 90° from the spring ribs 17*a* in the first set first set. The elasticity constant of the spring ribs 17*a* will be variable in dependence on the material of synthetic resin. The elasticity coefficient may be optionally decided in consideration of the thickness of the spring ribs 17*a*. As the spring ribs 17*a* are radially deformed due to the pressure given to the outer periphery 15 by the embossed information of the card P, the information is transcribed onto the print paper.

According to the first embodiment of the invention, the height of center axis of the roller shaft 6 is fixed with respect to the carriage B. The guide plates 5, 5 have oblong holes 5*b*, 5*b* provided therewith respectively, the oblong holes 5*b*, 5*b* being formed as symmetrical with horizontally extended portions and upwardly extended portions. With this structure, the transcription of the shop name plate placed on the shop plate receiving area 3 may be obtained while the roller C is moved in one direction from left to right in FIG. 1 and the transcription of the card P placed on the card receiving area 2 may be obtained while the roller C is moved back from right to left.

Subsequently the operation will be described. With the carriage B being moved across the printing base A having the printing paper placed on the card P which is received in the predetermined area, the roller C is moved with the carriage B as is rolled with the outer periphery 15 being in contact with the upper surface of the card P. As the roller C is made of a rigid body, the outer periphery 15 itself of the roller C is not radially deformed while it is rolled across the card P and thus the transcription of information is made from the card P to the printing paper due to a predetermined pressure given to the printing paper by the roller C.

In the meantime, the outer periphery 15 of the roller C is moved up by an amount as defined by the height H of the embossed portions of the card P with the vertical position (height) of the roller shaft 6 being unchanged. Precisely the outer periphery 15 of the roller C is moved up due to the action of the spring ribs 17*a*, 17*a* which are radially deformed between the center boss 16 and the outer periphery 15 of the roller C by the pressure given to the outer periphery 15 when the roller C is moved on the embossed portions of the card P. Thus the spring ribs 17*a*, 17*a* absolve the height H and height error ΔT of the embossed portions, and thus a high quality transcription of the information may be obtained namely, according to the embodiment, a high quality transcription of information may be obtained simply by making contact between the outer periphery 15 of the roller C and the embossed surface of the card P with a predetermined optional pressure applied. Thus the dirty and ambiguous transcription of information may be avoided without fail. In this connection, the roller C may be modified to have an elastic member such as gum and the like filled between the outer periphery 15 and the center boss 16 thereof instead of the radially extended arms 17 which are bent in substantially U-shape in vertical section at the intermediate thereof.

Further a second embodiment of the invention will be described. According to the second embodiment, the roller shaft 6 is arranged as is vertically displaceable with respect to the carriage B. Namely the roller shaft 6 is supported by a pair of bearings 10 by way of example which are held under the action of elastic members 11 and may be vertically movable against and under the action of elastic members 11 respectively. In this case, the roller C is wholly made of a rigid body and the height H and height error ΔT of the embossed portions of the card P may be absolved by the elastic members 11. Thus a high quality transcription of the information may be obtained while the roller C is moved on the card P.

Figure 7A:
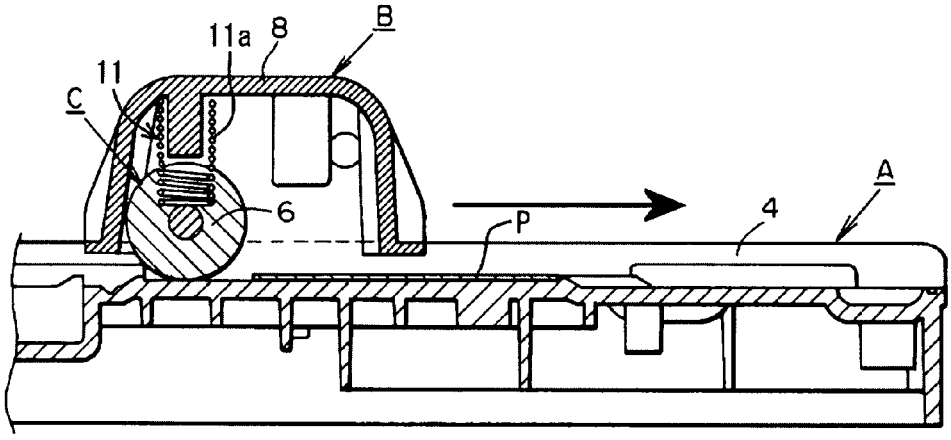
FIG. 7A is a side elevational view of a second embodiment of the imprinter shown in vertical section wherein the imprinter is not operated.
Figure 7B:
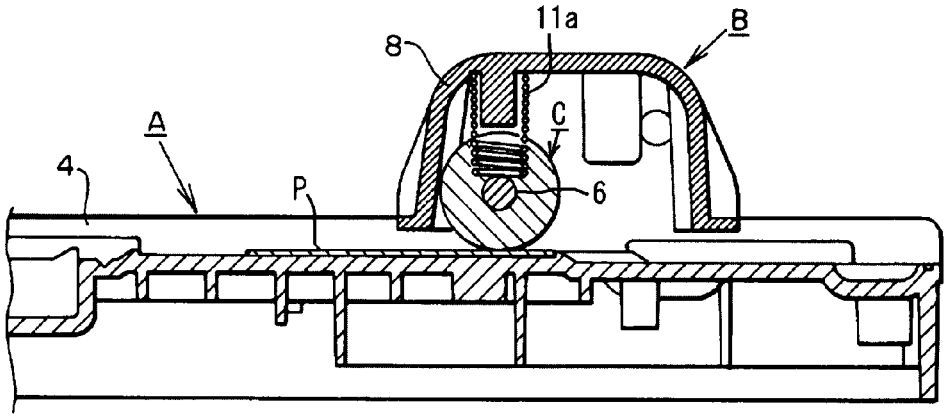
FIG. 7B is the side elevational view of the imprinter shown in vertical section wherein the imprinter is operated.
Figure 8A:
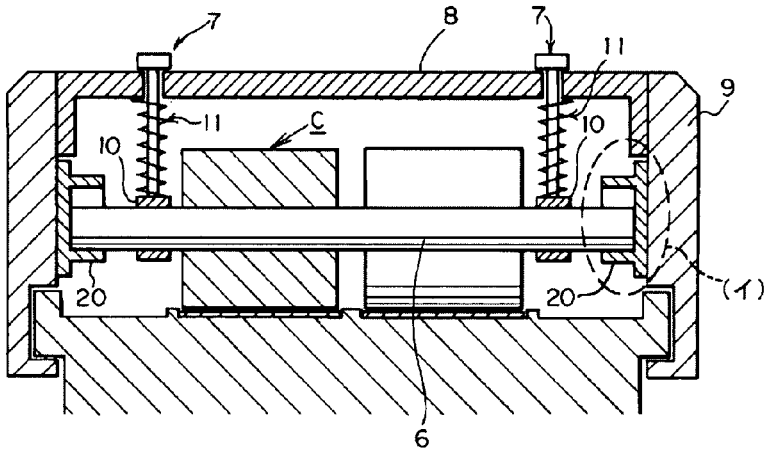
FIG. 8A is a side elevational view of an essential part of the second embodiment of the imprinter shown in vertical section wherein the roller shaft is under the action of springs arranged on the upper side of the roller shaft.
Figure 8B:
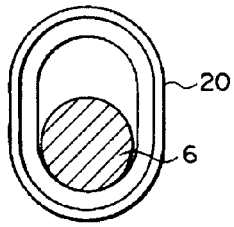
FIG. 8B is a side elevational view of the roller shaft shown in vertical section wherein one end of the roller is supported by a bearing.
Figure 8C:
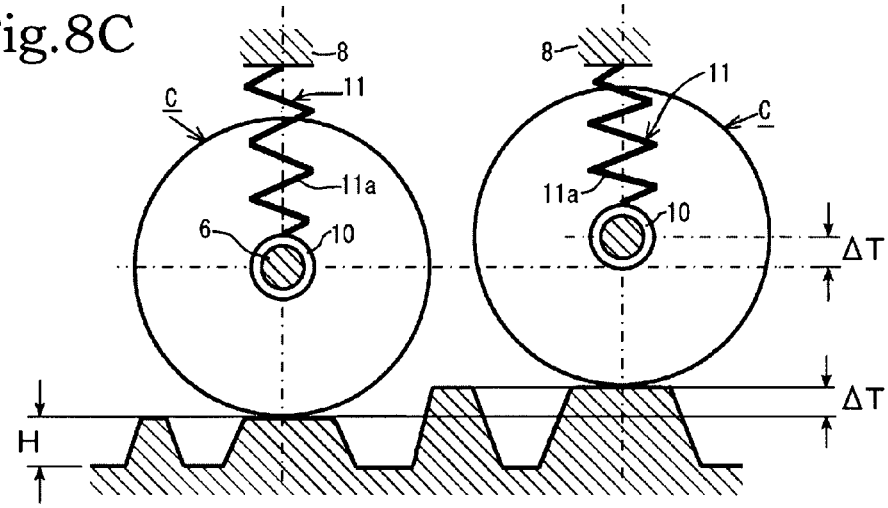
FIG. 8C is a front elevational view of the roller wherein the roller is shown as radially displaced due to a height and a height error respectively of embossed parts of a card during imprinting operation.
Figure 9A:
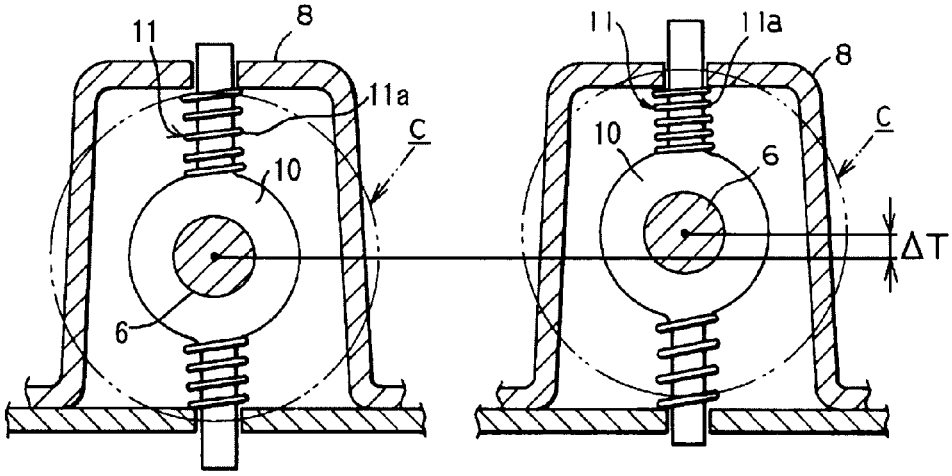
FIG. 9A is a front elevational view of the essential part of the second embodiment which is modified to have the roller shaft placed under the action of springs arranged on the upper and lower sides of the roller shaft.

The elastic members 11 may include coil springs 11*a* as shown in FIGS. 7, 8 and 9A. In FIGS. 7 and 8, the roller shaft 6 is shown as being vertically movable against and under the action of the coil springs 11*a* which are provided on the upper side of the roller shaft 6 because the roller shaft 6 has both ends supported by vertically elongated bearings 20 of the carriage B. In FIG. 9*a*, the roller shaft 6 is shown as being vertically movable against and under the action of the coil springs 11*a* which are provided on the upper and lower sides of the roller shaft 6.

Figure 9B:
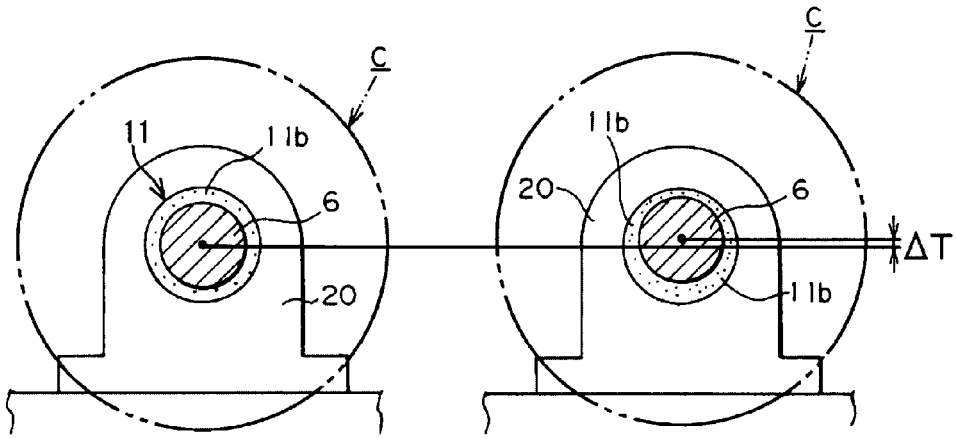
FIG. 9B is further a modification of FIG. 9A wherein the springs are replaced by a soft gum fitted between the roller and the roller shaft.

Further as shown in FIG. 9B, a soft synthetic gum member 11*b* may be filled between the roller shaft 6 and the bearings 20 of the carriage B instead of the coil springs 11*a*. The soft synthetic gum member 11*b* may absolve the vertical displacement amount ΔT of the roller shaft 6. More precisely the soft synthetic gum member 11*b* may be radially deformed to radially move up the roller shaft 6. Thus the second embodiment of the invention may have a same effect as the first embodiment.

Figures 10A, 10B:
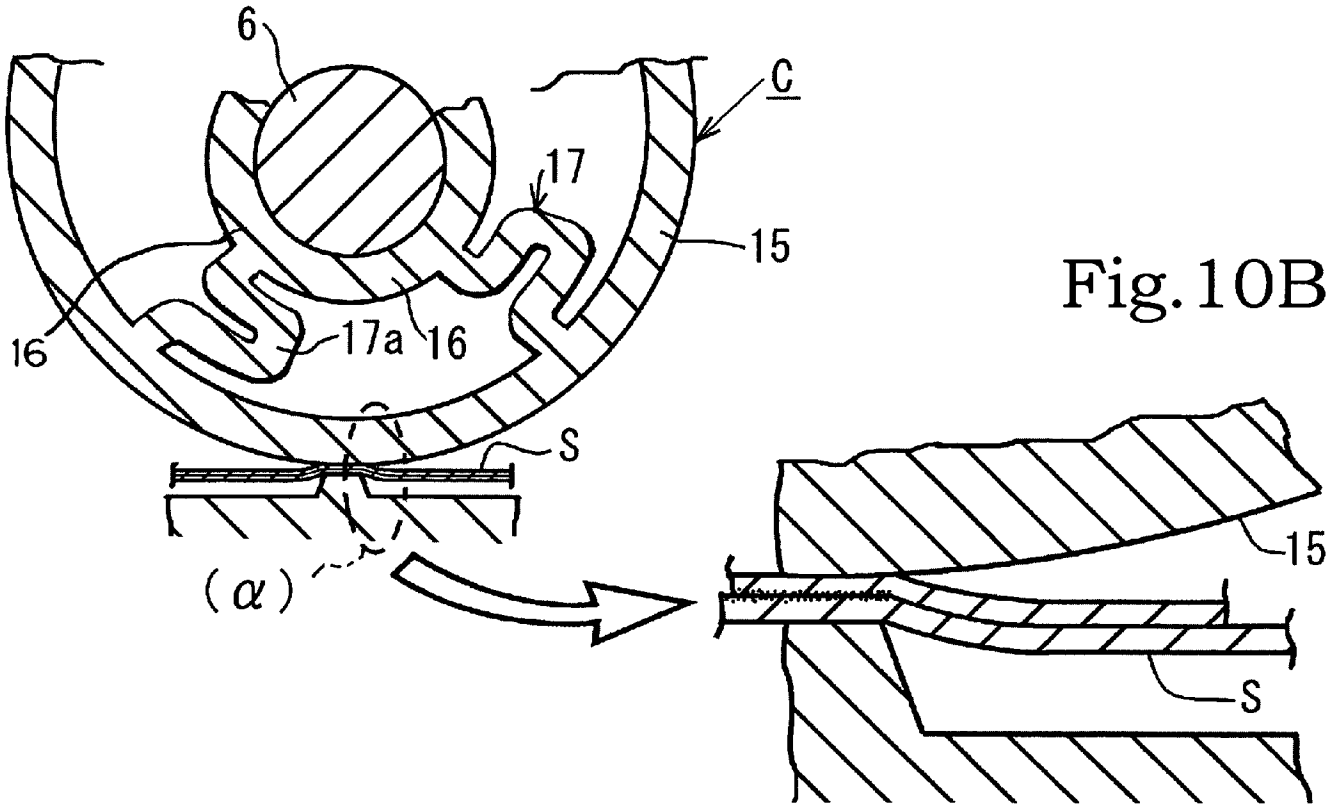
FIG. 10A is a side elevational view of the essential part the embodiment wherein the roller and the related parts are shown in vertical section while the roller is moved for imprinting operation.
FIG. 10B is an enlarged view of the part ($\alpha$) of FIG. 9A.

Thus according to the invention, as the roller C is placed under spring action, transcription of a fixed standard may be obtained if the thickness of the card happens to be different. Particularly in case the outer periphery 15 of the roller C is made of a rigid body and is under spring action, an appropriate pressure may be given to the print paper as shown in FIG. 10B wherein the outer periphery 15 of the roller C comes into point contact with the embossed part of the card without deformation of the periphery surface. As the result, a high quality of transcription (imprint) may be obtained.

It is a specific feature of the invention to arrange the roller C or the outer periphery 15 of the roller under spring action. Generally in case the printing pressure is adjusted in the vertical distance, the printing pressure depends upon the elastic deformation of the shaft and the printing base, though it is admitted that the transcription quality is good in a certain range. Therefore it is required that the printing pressure is adjusted in a condition that the spring constant is high. According to the invention, as the roller C or the outer periphery 15 of the roller is arranged under spring action, it has become technically possible to decrease the spring constant. As the result, the range for adjusting the printing pressure is increased. Thus it has become very easy to adjust the printing pressure.

As to the transcription, the transcription is made with a pressure being applied to the print paper S to which the card information is transcribed. According to the invention, as the roller C or the outer periphery 15 of the roller is arranged under spring action, it is unnecessary to adjust the printing pressure on the side of user once the printing pressure is adjusted at the factory before the imprinter is shipped. Further the print pressure adjusting work, that is, the manipulation of adjusting screws 7*a*, 7*a* at the factory is very easy in comparison with the conventional imprinter of the roller that is wholly made of a rigid body. This is because the roller C or the outer periphery 15 of the roller is arranged under the action of elastic members 11 which have the spring constant decreased and the elastic amount increased, that is, the adjusting range is increased.

Figure 11A:
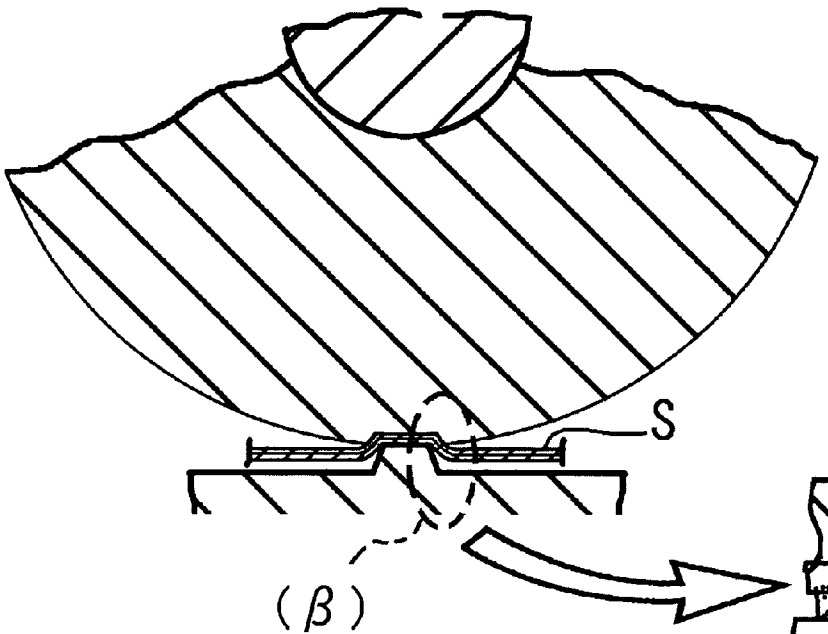
FIG. 11A is a side elevational view of the essential part the conventional imprinter wherein the roller and the related parts are shown in vertical section while the roller is moved for imprinting operation.
Figure 11B:
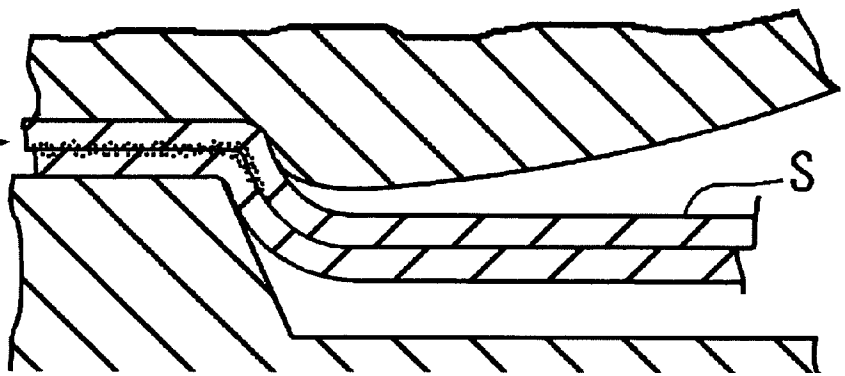
FIG. 11B is an enlarged view of the part ($\beta$) of FIG. 11A.

According to the invention, the print paper S (books or debit slip) is a pressure responsible paper and the roller C is made of a rigid body such as synthetic resin or metal. FIGS. 10 and 11 show the print paper S of two layers that is responsible to pressure. In FIGS. 10 and 11, the print paper S has a color former coated on the lower side of the upper layer and has a developer coated on the upper side of the lower layer. The color former and the developer are responsible to the pressure of roller C to transcribe the embossed information of the card onto the surface of the lower layer in a predetermined color.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An imprinter comprising:

a printing base for mounting a card and a print paper to be imprinted on a predetermined area thereof;

a carriage that is movable above the printing base;

a roller shaft housed within the carriage and fixedly arranged at a position of a predetermined height from the card mounting surface of the printing base; and a roller including an outer periphery comprising a rigid body formed contiguously across an entirety of the roller in an axial direction of the roller, a center boss that is in rotational engagement with the roller shaft and an elastic member provided between the outer periphery and the center boss of the roller, wherein the elastic member is radially deformed during an imprinting operation so as to cause a radial center of the outer periphery of the roller to radially move relative to a center axis of the roller shaft into a state of eccentric circle in a vertical section, so that the embossed information of the card may be transcribed onto the print paper, and wherein a radially extending line from the roller shaft, in a state where the roller shaft is disposed in a center of the roller, passes through a straight portion of the elastic member directly adjacent to the outer periphery of the roller and a straight portion of the elastic member directly adjacent to the roller shaft.

2. The imprinter as defined in claim 1, wherein said elastic member includes a plurality of spring ribs radially extended between the outer periphery and the center boss of the roller.

3. The imprinter as defined in claim 2, wherein said spring ribs are formed as one body with said outer periphery and the center boss of the roller by use of a single material, the single material including synthetic resin or metal.

4. The imprinter as defined in claim 1, further comprising an adjusting member manually operated to adjust the height of said roller from said printing base, thereby to adjust a density of transcription.

5. The imprinter as defined in claim 1, wherein an entirety of a circumference of the outer periphery of the roller moves in a same direction relative to the card.

6. The imprinter as defined in claim 1, wherein a circumference of the outer periphery of the roller comprises a hardness such that the outer periphery of the roller is not substantially deformed during the imprinting operation.

7. The imprinter as defined in claim 1, wherein a portion of the outer periphery of the roller contacting the card during the imprinting operation is displaced a distance toward the roller shaft and another portion of the outer periphery, disposed on an opposite side of the roller shaft, is displaced the distance away from the roller shaft.

8. The imprinter as defined in claim 1, wherein the elastic member comprises a plurality of radially extending arms.

9. The imprinter as defined in claim 8, wherein the plurality of radially extending arms include:

a straight section extending radially outward from the center boss;

a laterally bent portion connected to the straight section and forming a U-shape, the U-shape extending in a circumferential direction of the roller; and an other straight section connecting to a radially outer portion of the laterally bent portion and the outer periphery of the roller.

10. The imprinter as defined in claim 8, wherein a radially extending arm of the radially extending arms comprises a connection to the center boss and a connection to the outer periphery such that a line extending though the connections substantially extends in a radial direction of the roller.

11. The imprinter as defined in claim 8, wherein a radially extending arm of the radially extending arms comprises a connection to the center boss and a connection to the outer periphery such that a line extending through the connections is substantially perpendicular to a line tangent to an outer surface of the center boss.

12. The imprinter as defined in claim 1, wherein the outer periphery is formed such that a movement of a portion of the outer periphery is transferred to a remainder of the outer periphery.

13. The imprinter as defined in claim 1, wherein the outer periphery comprises a single member formed contiguously across the entirety of the roller in the axial direction of the roller.

14. The imprinter as defined in claim 1, wherein the outer periphery is formed so as to comprise a continuously formed outer surface.

15. The imprinter as defined in claim 1, wherein the roller includes a single outer periphery.

16. The imprinter as defined in claim 1, wherein a plane extending in a radial direction of the roller shaft passes through a position where the roller shaft connects with the elastic member and a position where the elastic member connects with the outer periphery of the roller when the elastic member is not radially deformed.

17. The imprinter as defined in claim 1, wherein a center portion of the elastic member comprises a U-shape.

* * * * *